US007252206B2

(12) United States Patent
Ireland

(10) Patent No.: US 7,252,206 B2
(45) Date of Patent: Aug. 7, 2007

(54) DOOR MECHANISM

(76) Inventor: David Ireland, 56 Center Ave., West Newton, PA (US) 15089

( * ) Notice: Subject to any disclaimer, the term of this patent is extended or adjusted under 35 U.S.C. 154(b) by 0 days.

(21) Appl. No.: 10/401,018

(22) Filed: Mar. 27, 2003

(65) Prior Publication Data

US 2004/0188453 A1 Sep. 30, 2004

(51) Int. Cl.
*B65D 45/16* (2006.01)
*B65D 90/62* (2006.01)
*E05C 1/12* (2006.01)

(52) U.S. Cl. ..... 220/315; 220/1.5; 220/324; 292/4; 292/57; 292/189; 292/DIG. 11; 49/465; 49/402

(58) Field of Classification Search ..... 220/1.5, 220/254.9, 318, 324, 661, 908, 315, 345.2, 220/351; 217/56, 62; 292/4–6, 42, 57, 58, 292/60–62, 120, 153, 189, 290, 292, 295, 292/296, 207, 217, DIG. 11; 49/57, 463, 49/465, 466, 402; 435/290.1; 490/290.1
See application file for complete search history.

(56) References Cited

U.S. PATENT DOCUMENTS

| | | | | | |
|---|---|---|---|---|---|
| 156,081 | A * | 10/1874 | Connor | 223/21 |
| 1,167,175 | A * | 1/1916 | Hicks | 292/42 |
| 1,364,970 | A * | 1/1921 | Wood | 292/4 |
| 2,622,285 | A * | 12/1952 | Roos | 52/202 |
| 3,234,908 | A * | 2/1966 | Doskocil | 119/496 |
| 3,861,081 | A * | 1/1975 | Maskell | 49/70 |
| 3,915,327 | A * | 10/1975 | Lovich et al. | 220/1.5 |
| 4,108,609 | A * | 8/1978 | Petzinger | 422/194 |
| 4,120,415 | A | 10/1978 | Hopkins et al. | |
| 4,545,523 | A | 10/1985 | Galbreath et al. | |
| 4,585,267 | A | 4/1986 | Friesen | |
| 4,726,616 | A | 2/1988 | Schmidt | |
| 4,819,820 | A * | 4/1989 | Weiner | 220/1.5 |
| 4,836,395 | A * | 6/1989 | Goutille | 220/1.5 |
| 4,913,301 | A | 4/1990 | Pickler | |
| 5,294,016 | A | 3/1994 | Crenshaw | |
| 5,299,099 | A * | 3/1994 | Archambault | 361/837 |
| 5,624,049 | A | 4/1997 | Kovash et al. | |
| 5,884,794 | A | 3/1999 | Calhoun et al. | |
| 6,149,209 | A * | 11/2000 | Barton | 292/67 |
| 6,152,672 | A | 11/2000 | Alson | |
| 6,364,153 | B1 | 4/2002 | Petztillo, Jr. et al. | |
| 6,576,462 | B2 * | 6/2003 | Thompson | 435/290.1 |
| 6,702,135 | B2 * | 3/2004 | Pickler | 220/1.5 |

FOREIGN PATENT DOCUMENTS

| | | | |
|---|---|---|---|
| DE | 29712970 U1 * | 9/1997 | |
| GB | 2229698 A * | 10/1990 | |

* cited by examiner

*Primary Examiner*—Anthony D. Stashick
*Assistant Examiner*—James Smalley
(74) *Attorney, Agent, or Firm*—The Webb Law Firm

(57) ABSTRACT

A door mechanism for a transportation container having a material receiving opening extending through a surface of the transportation container is disclosed. The door mechanism includes at least one substantially rigid door element to removably cover at least a portion of the material receiving opening of the transportation container. Further, the door mechanism includes at least one latching mechanism in operable communication with the door element for securing the door element over the material receiving opening and against at least a portion of an adjacent surface surrounding the material receiving opening. A transportation container is also disclosed.

12 Claims, 2 Drawing Sheets

DOOR MECHANISM

BACKGROUND OF THE INVENTION

1. Field of the Invention

The present invention relates generally to door mechanisms for transportation containers that are adapted to contain various materials for storage and transport, and, in particular, to a door mechanism for a transportation container having a material receiving opening extending through a surface of the transportation container.

2. Description of Related Art

Containers and transportation containers are used in various applications in the industries to temporarily store and contain materials prior to ultimate disposition. For example, many such transportation containers are used to hold garbage, waste material, refuse, discarded material, etc. Once the material is collected in the container, a vehicle, such as a truck, transports the container to a disposal location.

These transportation containers come in many shapes and sizes. Further, these containers can be movable on wheels and "staged" on the ground surface, thus requiring a vehicle to lift or tow the container. In order to appropriately house the material inside of the container, the container is typically a box-like structure with multiple sides, at least one of which is used to place the material therein. Various containers for carrying and/or transporting material are disclosed in U.S. Pat. Nos. 4,120,415 to Hopkins et al.; U.S. Pat. No. 4,545,523 to Galbreath et al.; U.S. Pat. No. 4,585,267 to Friesen; U.S. Pat. No. 4,726,616 to Schmidt; U.S. Pat. No. 4,913,301 to Pickler; U.S. Pat. No. 5,294,016 to Crenshaw; U.S. Pat. No. 5,624,049 to Kovash et al.; U.S. Pat. No. 5,884,794 to Calhoun et al.; U.S. Pat. No. 6,152,672 to Alson; and U.S. Pat. No. 6,364,153 to Petzitillo, Jr. et al.

The containers and boxes disclosed in the above-listed patents have several drawbacks. Many of these containers employ complicated and highly mechanical latching mechanisms, which are both expensive and difficult to operate and maintain. Further, many of these containers and boxes use door structures that either comprise the entire surface of a side of the container and/or remain physically attached to the container, at least at the hinge point. Still further, most of the mechanical doors are located in a different or difficult loading or material receiving area.

Presently, in transporting certain materials, pre-existing boxes or transportation containers have a material receiving opening extending through a surface, typically the rear surface, of the container. Further, these openings do not include any sort of door or containment means for retaining the waste or material in the container inner area. Therefore, according to the prior art, a tarpaulin or other soft material is strapped over the material receiving opening using multiple straps attached to multiple loops, which are, in turn, fixed to the container. This manner of containing the material in the container also has drawbacks. Soft pliant materials have a short life in such a rugged application. In addition, using the straps together with the material to prevent the material from exiting the container has failed consistently in application during transport. Such material lost during transport is not only undesirable, but may pose serious environmental and safety risks on the traversing infrastructure and roadways.

SUMMARY OF THE INVENTION

It is, therefore, an object of the present invention to provide a door mechanism that overcomes the deficiencies of the prior art. It is another object of the present invention to provide a door mechanism that is capable of being retrofitted on preexisting transportation containers. It is yet another object of the present invention to provide a door mechanism that is efficiently securable to a surface of the container and over the material receiving opening, thusly ensuring that material does not exit the container during transport. It is a still further object of the present invention to provide a door mechanism that is inexpensive in its manufacture and easy to use in the field. It is another object of the present invention to provide a door mechanism that does not have a complicated mechanical structure and reduces the risk of failure. It is still another object of the present invention to provide a door mechanism that requires minimal maintenance, and, to the extent maintenance is required, such maintenance activity is easy to perform.

The present invention is directed to a door mechanism for a transportation container. The transport container has a material receiving opening that extends through a surface of the transportation container. For example, this surface can be a rearward surface and the material receiving opening can be sized and shaped so as to enjoin or mate with a waste receiving or waste compacting machine. The door mechanism includes at least one substantially rigid door element that at least partially and removably covers the material receiving opening of the transportation container. Further, the door mechanism includes at least one latching mechanism in operable communication with the door element for securing the door element over the material receiving opening and against a portion of an adjacent surface surrounding the material receiving opening.

In a preferred embodiment, the door mechanism includes a first door element and a second door element that are positioned adjacent each other. Each of the first door element and the second door element removably cover at least a portion of the material receiving opening, and are typically sized to each cover about one-half of the overall material receiving opening. The latching mechanism may have any one of various preferred structures, as disclosed hereinafter and may include multiple latching mechanisms for further securement.

The present invention, both as to its construction and its method of operation, together with the additional objects and advantages thereof, will best be understood from the following description of exemplary embodiments when read in connection with the accompanying drawings.

DESCRIPTION OF THE PREFERRED EMBODIMENTS

Figure 1:
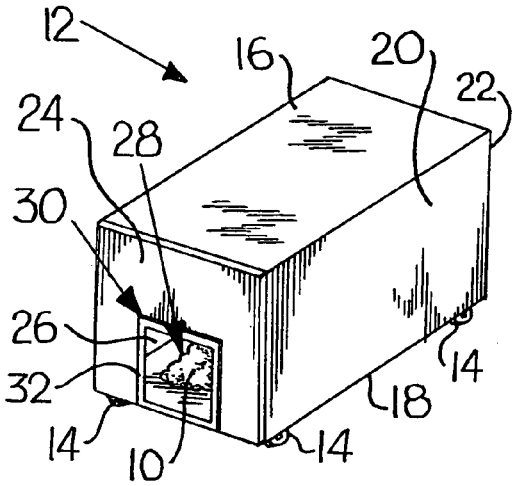
Fig. 1 (Prior Art)
FIG. 1 is a perspective view of a transportation container according to the prior art.

For purposes of the description hereinafter, the terms "upper", "lower", "right", "left", "vertical", "horizontal", "top", "bottom", "rear", "side", "front" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

In order to temporarily house and transport material 10 from one location to another location, it is well known in the art to use a transportation container 12. As seen in FIG. 1, the transportation container is a box-like structure, often supported by wheels 14, which allow the transportation container 12 to be moved by another vehicle (not shown), such as a truck or the like. Due to its box-like structure, the transportation container 12 includes a top surface 16, a bottom surface 18, two side surfaces 20, a front surface 22 and a rear surface 24.

In normal operation, the transportation container 12 includes some hook-up mechanism for connecting the front surface 22 or bottom surface 18 to the vehicle. Similarly, in order to allow access for placement of the material 10 in the transportation container 12, a material receiving opening 26 is positioned on a surface (16, 18, 20, 22, 24) of the transportation container 12, and typically this is the rear surface 24. The material receiving opening 26 therefor extends through the rear surface 24 providing access to an inner area 28 of the transportation container 12.

It is also envisioned that in the prior art, the entire rear surface 24 can act as a door, which is hinged to the remaining structure of the transportation container 12. This would allow the entire rear surface 24 to be opened, therefore allowing better access into the inner area 28. However, since the rear surface 24, and the overall size of the transportation container 12, is large, opening the rear surface 24 is often not feasible. In addition, when the material 10 is a waste, refuse or garbage material, the material receiving opening 26 is sized and shaped so as to mate with or enjoin another waste receiving machine or piece of equipment, such as a trash compactor. Further, in order to provide a better abutting relationship between an adjacent surface 30 surrounding the material receiving opening 26, as between the rear surface 24 and another machine, the adjacent surface 30 may be in the form of an adjacent rim structure 32. This adjacent rim structure 32 may partially or wholly surround the material receiving opening 26.

Figure 2:
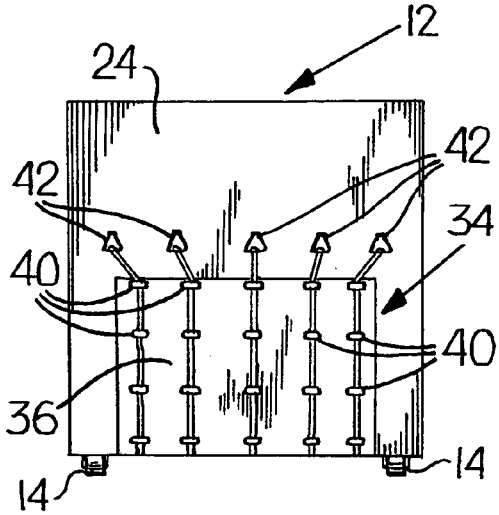
Fig. 2 (Prior Art)
FIG. 2 is an edge view of the transportation container of FIG. 1 with a door mechanism according to the prior art covering a material receiving opening.

During transport or movement of the transportation container 12, if the material receiving opening 26 is uncovered, the material 10 would simply move within the inner area 28 and possibly drop or fall out of the material receiving opening 26 onto a roadway surface. As seen in FIG. 2, in the prior art, such easy spillage has been minimized by the use of a fabric barrier arrangement 34. Simply, a fabric barrier element 36 is placed over the material receiving opening 26, such that it covers and separates the inner area 28 from the area outside the transportation container 12. In order to secure the fabric barrier element 36 to the rear surface 24 of the transportation container 12, one or more straps 38 are inserted through corresponding barrier loops 40, which are attached directly to the fabric barrier element 36. Multiple barrier loops 40 are often used for a single strap 38 in order to more fully secure the fabric barrier element 36 over the material receiving opening 26.

In order to secure the straps 38 to the transportation container 12, multiple container loops 42 are provided. Typically, these container loops 42 are provided on the rear surface 24 of the transportation container 12, as well as the bottom surface 18 of the transportation container 12. Specifically, a set of container loops 42 is used for each single strap 38, which extends through multiple barrier loops 40. In this manner, the fabric barrier element 36 is held against the adjacent surface 30 or adjacent rim structure 32 of the transportation container 12 and effectively covers the material receiving opening 26. However, due to the drawbacks discussed above, including failure and possible leakage, the fabric barrier arrangement 34 is deficient.

Figure 3:
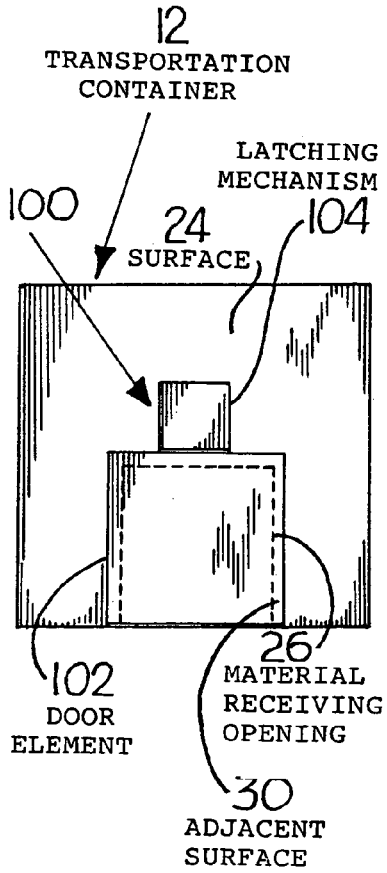
FIG. 3 is a schematic view of a transportation container with a door mechanism according to the present invention.

In order to overcome the deficiencies of the prior art, the present invention is a door mechanism 100 for use in connection with the transportation container 12, which again has the material receiving opening 26 extending through a surface (16, 18, 20, 22, 24) and typically the rear surface 24 of the transportation container 12. The door mechanism includes at least one substantially rigid door element 102 that removably covers at least a portion of the material receiving opening 26 of the transportation container 12. Further, the door mechanism 100 includes at least one latching mechanism 104 in operable communication with the door element 102. This latching mechanism 104 secures the door element 102 over the material receiving opening 26 and against at least a portion of the adjacent surface 30 surrounding the material receiving opening 26. The door mechanism 100 is shown in schematic form in FIG. 3.

Figure 4:
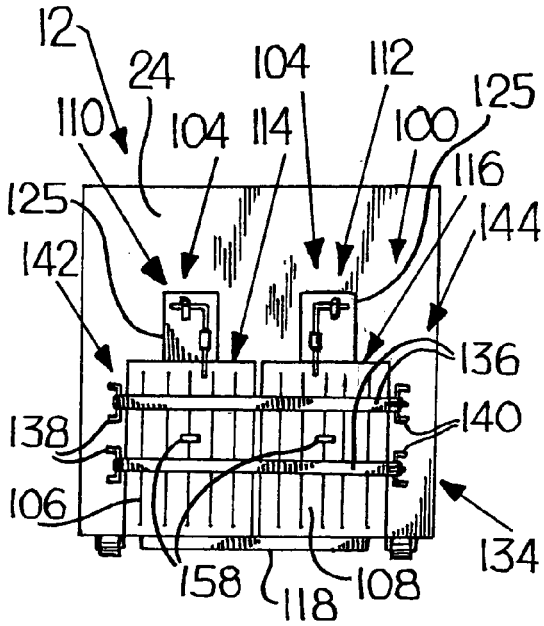
FIG. 4 is an edge view of a transportation container with a preferred embodiment of a door mechanism according to the present invention.

A preferred embodiment of the door mechanism 100, as installed on the transportation container 12, is illustrated in FIG. 4. In this preferred and non-limiting embodiment, the door mechanism 100 includes a first door element 106 and a second door element 108. The first door element 106 and the second door element 108 are positioned substantially adjacent with respect to each other and each removably cover a respective portion of the material receiving opening 26. Typically, the first door element 106 and the second door element 108 are of similar size and shape, each covering roughly half of the material receiving opening 26. The use of multiple door elements (106, 108) decreases the overall dimension and weight of each door element 102, making manipulation and removal easier. It is also envisioned that the first door element 106 and the second door element 108 are physically attached to each other at a respective edge, thereby forming a single integral door element 102. This would allow each door element (106, 108) to be formed separately and, thereafter, attached together to fully and uniformly cover the material receiving opening 26.

In this embodiment, each of the first door element 106 and the second door element 108 are in operable communication with a respective first latching mechanism 110 and second latching mechanism 112. The first latching mechanism 110 removably secures the first door element 106 over a first portion 114 of the material receiving opening 26 and against at least a portion of the adjacent surface 30 that surrounds the first portion 114 of the material receiving opening 26. Similarly, the second latching mechanism 112 removably secures the second door element 108 over a second portion 116 of the material receiving opening 26 and against at least a portion of the adjacent surface 30 surrounding the second portion 116 of the material receiving opening 26. As discussed above, when the first door element 106 and the second door element 108 are manufactured separately but attached together thereafter, it may still be preferable to use the first latching mechanism 110 and the second latching mechanism 112. Specifically, and since the first door element 106 and the second door element 108 are normally manufactured from a plastic material, this material tends to "bow," such that when the first latching mechanism 110 is being secured over the first door element 106, the second door element 108 tends to flex outward. Therefore, after the first latching mechanism 110 is engaged with the first door element 106, the second latching mechanism 112 is then engaged with the second door element 108. The use of the first latching mechanism 110 and the second latching mechanism 112 provides for better overall security with respect to the door element (102, 106, 108) as against and over the material receiving opening 26.

The door mechanism 100 may also include a support ridge 118 attached to the adjacent surface 30 of the material receiving opening 26. The support ridge 118 supports the door element 102, or in the case of the previous embodiment, the first door element 106 and the second door element 108. Further, the support ridge 118 is typically attached directly to the rear surface 24 or the bottom surface 18 of the transportation container 12. In a preferred embodiment, the support ridge 118 is substantially U-shaped and has an inner support area 120. It is this inner support area 120 that is capable of accepting a portion, and typically the bottom portion, of the door element (102, 106, 108). The support ridge 118 may be attached to the transportation container 12 in any manner, as well known in the art, such as by welding, etc.

Figure 5:
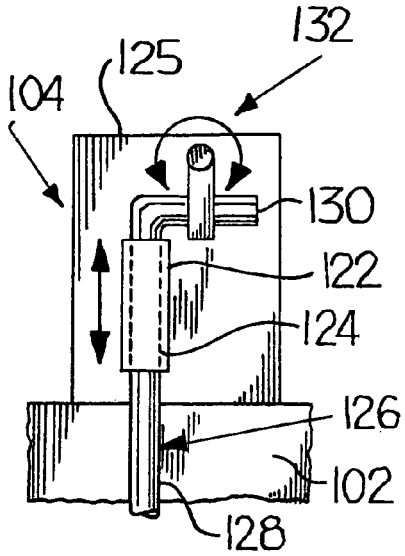
FIG. 5 is a front view of a preferred embodiment of a latching mechanism according to the present invention.

As seen in FIGS. 4 and 5, the latching mechanism (104, 110, 112) can include a sleeve element 122 having an insertion opening 124 extending therethrough. The sleeve element 122 may take the form of a pipe or conduit structure. The sleeve element 122 is attached to the adjacent surface 30 of the transportation container 12. In order to appropriately orient the latching mechanism (104, 110, 112) with respect to the door element (102, 106, 108) a projection surface 125 can be used. This projection surface 125 effectively spaces the latching mechanism (104, 110, 112) away from the adjacent surface 30 of the transportation container 12.

In this embodiment, the latching mechanism (104, 110, 112) also includes a retaining element 126 that is sized and shaped so as to be inserted through the insertion opening 124 of the sleeve element 122. The retaining element 126 is also sized and shaped so as to contact the door element (102, 106, 108) and latch the door element (102, 106, 108) over the material receiving opening 26. In a preferred embodiment, the retaining element 126 is substantially L-shaped with a vertical portion 128 and horizontal portion 130. In operation, the retaining element 126 is placed through the insertion opening by moving the vertical portion 128 of the retaining element 126 through the insertion opening 124 until the horizontal portion 130 of the retaining element 126 abuts the sleeve element 122. In another preferred embodiment, the projection surface 125 to which the sleeve element 122 is attached may also be beveled or angled. Such an angle would permit the retaining element 126 to better engage and abut the surface of the door element (102, 106, 108).

Using the L-shaped retaining element 126 allows the user to grasp the horizontal portion 130 and remove the retaining element 126 from the sleeve element 122. However, during transport, dependent upon road conditions, the retaining element 126 may be jarred from the sleeve element 122. In order to prevent this, the latching mechanism (104, 110, 112) may also include a retaining element latch 132, which is rotatably attached to the adjacent surface 30 (or projection surface 125) of the transportation container 12, specifically in the area near the sleeve element 122. This retaining element latch 132 is in operable communication with a portion of the retaining element 126, and typically the horizontal portion 130. The retaining element latch 132 can rotate around and is spaced from the rear surface 24 of the transportation container 12, such that it can be rotated over the horizontal portion 130 of the retaining element 126. It is also envisioned that the retaining element latch 132 is sized, shaped and spaced so as to frictionally contact the horizontal portion 130 of the retaining element 126. This retaining element latch 130 would prevent the retaining element 126 from being jarred or removed from the sleeve element 122 in circumstances when such removal is not desired.

Often, additional securement properties are desired. In order to accomplish this, a secondary latching mechanism 134 can be used. The secondary latching mechanism is in operable communication with the door element (102, 106, 108) and further secures the door element (102, 106, 108) over the material receiving opening 26 and against a portion of the adjacent surface 30 surrounding the material receiving opening 26. As seen in FIG. 4, the secondary latching mechanism can be a strap element 136 that is capable of being removably secured to a surface (16, 18, 20, 22, 24) of the transportation container 12. In a preferred and non-limiting embodiment, the secondary latching mechanism 134 also includes at least one first side loop element 138 and at least one second side loop element 140. The first side loop element 138 is attached to a first position 142 on a surface (16, 18, 20, 22, 24), typically at the rear surface 24, of the transportation container 12, and the second side loop element 140 is attached in a second position 144 on a surface (16, 18, 20, 22, 24), again typically at the rear surface 24, of an opposite side of the material receiving opening 26. The strap element 136 is removably securable to the first side loop element 138 and the second side loop element 140. When attached, the strap element 136 further secures the door element (102, 106, 108) against the adjacent surface 30 or adjacent rim structure 32 surrounding the material receiving opening 26.

Figure 6:
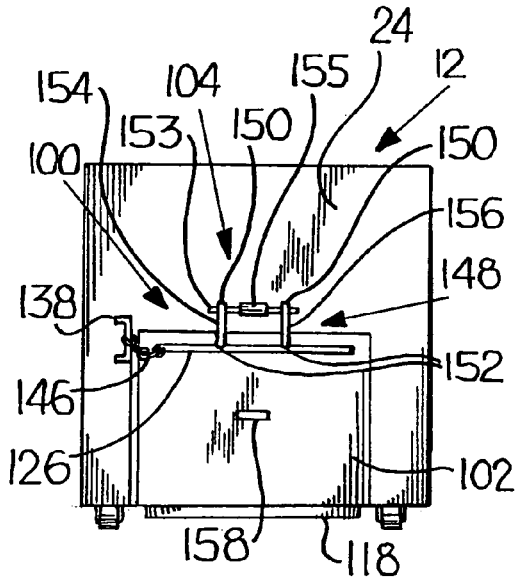
FIG. 6 is an edge view of a transportation container with a door mechanism according to the present invention.

The secondary latching mechanism 34 may also be in operable communication with the latching mechanism (104, 110, 112), as seen in FIG. 6. For example, the secondary latching mechanism 134, in this preferred and non-limiting embodiment, may be a chain element 146 that can be removably secured to a surface (16, 18, 20, 22, 24) of the transportation container 12. As with the strap element 136, the chain element 146 may also be attached to the first side loop element 138 and/or the second side loop element 140. It is also envisioned that multiple first side loop elements 138 and second side loop elements 140 can be positioned on the surface (16, 18, 20, 22, 24) of the transportation container 12 and multiple secondary latching mechanisms 34 can be utilized.

Figure 7:
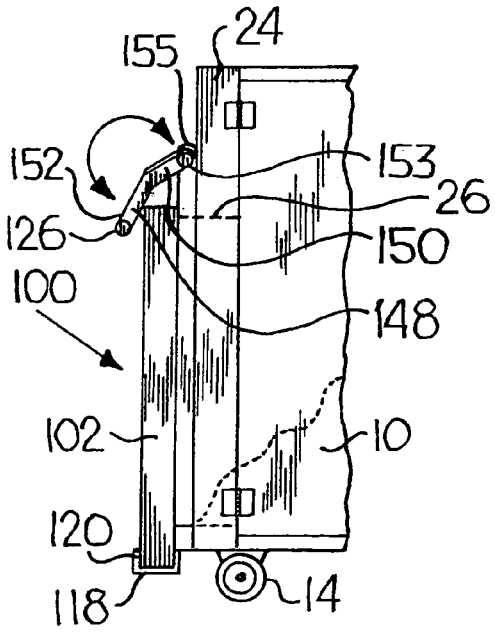
FIG. 7 is a side view of the transportation container and door mechanism of FIG. 6.

As seen in FIGS. 6 and 7, in another preferred and non-limiting embodiment, the latching mechanism (104, 110, 112) may include at least one pivot arm 148 having a pivot arm first end 150 and a pivot arm second end 152. The pivot arm first end 150 is pivotally attached to a surface (16, 18, 20, 22, 24) and typically an adjacent surface 30 of the transportation container 12. In a preferred pivoting arrangement, the pivot arm first end 150 can be attached to a sleeve arm 153, which extends through a sleeve element 155. The sleeve element 155 is attached to a surface (16, 18, 20, 22, 24) and typically the adjacent surface 30 of the transportation container 12. The sleeve arm 153 is inserted therethrough, and the pivot arm first end 150 is attached to the sleeve arm, thus creating a rotatable or pivotal latching mechanism (104, 110, 112). In this embodiment, the retaining element 126 is attached to the second end 152 of the pivot arm 148 and contacts the door element (102, 106, 108) and thereby latches the door element (102, 106, 108) over the material receiving opening 26.

In another similar preferred and non-limiting embodiment, the latching mechanism (104, 110, 112) includes a first pivot arm 154 and a second pivot arm 156, both pivotally attached at an end to a surface (16, 18, 20, 22, 24) of the transportation container 12. As with the above-discussed embodiment, a respective end of both the first pivot arm 154 and the second pivot arm 156 can be attached to the sleeve arm 153, preferably on either end of the sleeve arm 153 that is exposed or protrudes from the sleeve element 155. Again, similarly, the retaining element 126 is attached to both the first pivot arm 154 and the second pivot arm 156. Retaining element 126 can be a rigid bar structure that extends in a direction substantially transverse to the pivot arm (148, 154, 156). Using the weight of the retaining element 126, together with the pivoting functionality of the pivot arm (148, 154, 156) serves to secure the door element (102, 106, 108) over the material receiving opening 26 and against the adjacent surface 30 of the material receiving opening 26.

Figure 8:
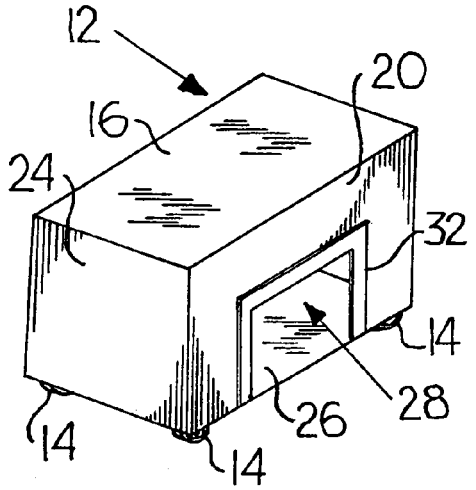
FIG. 8 is a perspective view of another embodiment of a transportation container.

By using the latching mechanism (104, 110, 112) and the rigid and removable door element (102, 106, 108), the material receiving opening 26 is effectively and securely covered, thereby blocking the inner area 28 from an area outside the transportation container 12. It is also envisioned that the material receiving opening 26 can be on any surface (16, 18, 20, 22, 24) of the transportation container 12. For example, as seen in FIG. 8, the material receiving opening 26 can be located or positioned on one of the side surfaces 20 of the transportation container 12. As discussed above, the transportation container 12 can hold or contain any material 10, for example, garbage, waste material, refuse, and discarded material.

The door element (102, 106, 108) can be manufactured from a variety of materials, such as rigid plastic material, metal, semi-metal, etc. Further, the door mechanism 100 may include a handle 158 attached thereto. Such a handle 158 would permit a user to grasp the handle 158 and manipulate the door element (102, 106, 108).

Overall, the present invention provides a door mechanism 100 that is able to be fitted or retrofitted to a transportation container 12 having a material receiving opening 26. Since the door element (102, 106, 108) is rigid, and through cooperation with the support ridge 118 and the latching mechanism (104, 110, 112), the door element (102, 106, 108) is securely held against an adjacent surface 30 or adjacent rim structure 32 surrounding the material receiving opening 26. The secondary latching mechanism 134 provides further securement characteristics. The present invention provides a door mechanism 100 that better contains the material 10 in the inner area 28 of the transportation container 12 during collection and/or transport. This, in turn, assists in reducing spillage of material 10, which provides positive environmental benefit. Further, the door mechanism 100 has increased durability and thus overall life during operation.

This invention has been described with reference to the preferred embodiments. Obvious modifications and alterations will occur to others upon reading and understanding the preceding detailed description. It is intended that the invention be construed as including all such modifications and alterations.

The invention claimed is:

1. A door mechanism for retrofitting to an existing transportation container having a material receiving opening extending through a surface of the transportation container, the door mechanism comprising:

a first door element and a second door element positioned substantially adjacent each other and configured to removably cover at least a portion of the material receiving opening; of the transportation container, wherein the substantially rigid door element is removable from the transportation container;

at least one latching mechanism in operable communication with the at least one door element and configured to secure the door element over the material receiving opening and against at least a portion of an adjacent outer surface surrounding the material receiving opening;

a support ridge attached to a surface of the transportation container and configured to support the at least one door element; and wherein each of the first door element and the second door element are in operable communication with a respective first latching mechanism and second latching mechanism, with the first latching mechanism configured to removably secure the first door element over a first portion of the material receiving opening and against at least a portion of an adjacent surface surrounding the first portion of the material receiving opening, and with the second latching mechanism configured to removably secure the second door element over a second portion of the material receiving opening and against at least a portion of an adjacent surface surrounding the second portion of the material receiving opening.

2. A door mechanism for retrofitting to an existing transportation container having a material receiving opening extending through a surface of the transportation container, the door mechanism comprising:

at least one substantially rigid door element configured to cover at least a portion of the material receiving opening of the transportation container, wherein the substantially rigid door element is removable from the transportation container;

at least one latching mechanism in operable communication with the at least one door element and configured to secure the door element over the material receiving opening and against at least a portion of an adjacent outer surface surrounding the material receiving opening;

a support ridge attached to a surface of the transportation container and configured to support the at least one door element;

at least one sleeve element having an insertion opening and attached to the adjacent surface of the transportation container;

at least one retaining element configured to be inserted through the insertion opening and configured to contact the door element and latch the door element over the material receiving opening; and a retaining element latch rotatably attached to the adjacent surface of the transportation container and in operable communication with at least a portion of the at least one retaining element, with the retaining element latch further configured to rotate over and contact at least a portion of the at least one retaining element.

3. The door mechanism of claim 2, wherein the support ridge is a substantially U-shaped element having an inner support area configured to accept a portion of the at least one door element.

4. The door mechanism of claim 2, wherein the at least one retaining element is a substantially L-shaped element.

5. The door mechanism of claim 2, wherein the transportation container is adapted to contain at least one of garbage, waste material, refuse and discarded material.

6. The door mechanism of claim 2, wherein the at least one door element is manufactured from one of a rigid plastic material, a metal and a semi-metal.

7. The door mechanism of claim 2, wherein the material receiving opening extends through a movable transportation container surface door.

8. The door mechanism of claim 7, wherein the movable transportation container surface door is located on at least one of a side surface, a rear surface and a front surface of the transportation container.

9. The door mechanism of claim 2, wherein the at least one door element includes a handle attached to the door element and configured to permit a user to grasp the handle and manipulate the door element.

10. A door mechanism for retrofitting to an existing transportation container having a material receiving opening extending through a surface of the transportation container, the door mechanism comprising:

at least one substantially rigid door element configured to cover at least a portion of the material receiving opening of the transportation container, wherein the substantially rigid door element is removable from the transportation container;

at least one latching mechanism in operable communication with the at least one door element and configured to secure the door element over the material receiving opening and against at least a portion of an adjacent outer surface surrounding the material receiving opening;

a support ridge attached to a surface of the transportation container and configured to support the at least one door element; and a secondary latching mechanism in operable communication with the at least one door element and configured to secure the door element over the material receiving opening and against at least a portion of an adjacent surface surrounding the material receiving opening;

wherein the secondary latching mechanism comprises at least one strap element configured to be removably secured to the surface of the transportation container.

11. A door mechanism for retrofitting to an existing transportation container having a material receiving opening extending through a surface of the transportation container, the door mechanism comprising:

a substantially rigid door element configured to cover the material receiving opening; wherein the door element is removable from the transportation container; wherein the door element is in operable communication with a latching mechanism, with the latching mechanism configured to removably secure the door element over a portion of the material receiving opening and against at least a portion of an adjacent outer surface surrounding the portion of the material receiving opening; and a support ridge attached to a surface of the transportation container and configured to support the door element;

wherein the latching mechanism includes:

(i) at least one sleeve element having a insertion opening and attached to the adjacent outer surface of the transportation container;

(ii) at least one retaining element configured to be inserted through the insertion opening and configured to contact the door element and latch the door element over the portion of the material receiving opening; and (iii) a retaining element latch rotatably attached to the adjacent surface of the transportation container and in operable communication with at least a portion of the at least one retaining element, with the retaining element latch further configured to rotate over and contact at least a portion of the at least one retaining element.

12. A door mechanism for retrofitting to an existing transportation container having a material receiving opening extending through a surface of the transportation container, the door mechanism comprising:

at least one substantially rigid door element configured to cover at least a portion of the material receiving opening of the transportation container, wherein the substantially rigid door element is removable from the transportation container;

at least one latching mechanism in operable communication with the at least one door element and configured to secure the door element over the material receiving opening and against at least a portion of an adjacent outer surface surrounding the material receiving opening;

a support ridge attached to a surface of the transportation container and configured to support the at least one door element; and a secondary latching mechanism in operable communication with the at least one door element and configured to secure the door element over the material receiving opening and against at least a portion of an adjacent surface surrounding the material receiving opening;

wherein the secondary latching mechanism comprises:

at least one strap element configured to be removably secured to the surface of the transportation container;

at least one first side loop element attached in a first position on a surface of the transportation container;

at least one second side loop element attached in a second position on the surface on an opposite side of the material receiving opening; and wherein the strap element is configured to be removably securable to the first side loop element and the second side loop element.

* * * * *